United States Patent [19]

Brattan

[11] Patent Number: 4,832,804

[45] Date of Patent: May 23, 1989

[54] ELECTROLYTIC CELL

[75] Inventor: Keith Brattan, Gt. Boughton, England

[73] Assignee: Imperial Chemical Industries PLC, London, England

[21] Appl. No.: 62,688

[22] Filed: Jun. 16, 1987

[30] Foreign Application Priority Data

Jun. 17, 1986 [GB] United Kingdom ..... 8614707

[51] Int. Cl.[4] ..... C25B 1/14; C25B 15/08; C25B 9/00

[52] U.S. Cl. ..... 204/98; 204/237; 204/255; 204/257; 204/263; 204/269; 204/275

[58] Field of Search ..... 204/255, 257, 263, 269, 204/275, 98, 128, 237

[56] References Cited

U.S. PATENT DOCUMENTS

| | | | |
|---|---|---|---|
| 669,439 | 3/1901 | Frasch | 204/237 |
| 2,196,355 | 4/1940 | Cremer | 204/237 |
| 3,296,114 | 1/1967 | Lloyd | 204/237 X |
| 3,361,663 | 1/1968 | Murray et al. | 204/275 X |
| 3,536,594 | 10/1970 | Pritchard | 204/275 X |
| 3,901,774 | 8/1975 | Motani et al. | 204/257 X |
| 4,338,178 | 6/1982 | Efimov et al. | 204/275 |
| 4,425,215 | 1/1984 | Henes | 204/258 |
| 4,465,579 | 8/1984 | Mataga et al. | 204/257 X |
| 4,505,789 | 3/1985 | Ford | 204/128 |

FOREIGN PATENT DOCUMENTS

| | | |
|---|---|---|
| 0046603 | 3/1982 | European Pat. Off. . |
| 0053807 | 6/1982 | European Pat. Off. . |

*Primary Examiner*—Donald R. Valentine

*Attorney, Agent, or Firm*—Cushman, Darby & Cushman

[57] ABSTRACT

An electrolytic cell which comprises at least one anode and at least one cathode, an inlet channel through which liquor may be charged to the electrolytic cell, and an outlet channel through which liquor may be removed from the electrolytic cell, in which the outlet channel is operatively connected to the inlet channel, and in which the inlet channel comprises an ejector. The inlet and outlet channels may be formed in a unit made up of a plurality of shaped sheets, e.g. of electrically non-conducting plastics material, which together form the inlet and outlet channels.

12 Claims, 2 Drawing Sheets

ELECTROLYTIC CELL

This invention relates to an electrolytic cell and in particular to an electrolytic cell which is provided with liquor recirculating means.

Electrolytes, for example, aqueous solutions of alkali metal chlorides, particularly sodium chloride, are electrolysed on a vast scale throughout the world in order to produce products such as chlorine and aqueous alkali metal hydroxide solution. The electrolysis may be effected in an electrolytic cell comprising a plurality of anodes and cathodes with each anode being separated from the adjacent cathode by a separator which divides the electrolytic cell into a plurality of anode and cathode compartments.

The electrolytic cell may be of the diaphragm or membrane type. In the diaphragm type cell the separators positioned between adjacent anodes and cathodes are microporous and in use aqueous electrolyte passes through the diaphragms from the anode compartments to the cathode compartments of the cell. In the membrane type cell the separators are essentially hydraulically impermeable and in use ionic species are transported across the membranes between the anode compartments and the cathode compartments of the cell.

For example, where aqueous alkali metal chloride solution is electrolysed in an electrolytic cell of the diaphragm type the solution is charged to the anode compartments of the cell, chlorine which is produced in the electrolysis is removed from the anode compartments of the cell, the alkali metal chloride solution passes through the diaphragms and hydrogen and alkali metal hydroxide produced by electrolysis are removed from the cathode compartments, the alkali metal hydroxide being removed in the form of an aqueous solution of alkali metal chloride and alkali metal hydroxide. Where an aqueous alkali metal chloride solution is electrolysed in an electrolytic cell of the membrane type the solution is charged to the anode compartments of the cell and chlorine produced in the electrolysis and depleted alkali metal chloride solution are removed from the anode compartments, alkali metal ions are transported across the membranes to the cathode compartments of the cell to which water or dilute alkali metal hydroxide solution may be charged, and hydrogen and alkali metal hydroxide solution produced by the reaction of alkali metal ions with water are removed from the cathode compartments of the cell.

The electrolysis may be effected in an electrolytic cell of the filter press type which may comprise a large number of alternating anodes and cathodes, for example, fifty anodes alternating with fifty cathodes, although the cell may comprises even more anodes and cathodes, for example up to one hundred and fifty alternating anodes and cathodes.

The electrolytic cell may be provided with an inlet header through which electrolyte, for example aqueous alkali metal chloride solution, may be charged to the anode compartments of the cell, and with an outlet header through which products of electrolysis may be removed therefrom. Also, the electrolytic cell may be provided with an outlet header through which products of electrolysis may be removed from the cathode compartments of the cell, and optionally, e.g. in the case of a membrane type cell, with an inlet header through which liquor, for example water or other fluid, may be charged thereto.

Electrolytic cells may be fitted with means for recirculating the liquors to the anode and/or cathode compartments of the cell. For example, in an electrolytic cell of the membrane type in which aqueous alkali metal chloride solution is electrolysed the solution is charged to the anode compartments of the cell through an inlet header and chlorine and depleted aqueous alkali metal chloride solution are removed therefrom through an outlet header. The electrolytic cell may be equipped with means for recirculating the depleted alkali metal chloride solution, or a part thereof, back to the anode compartments of the cell for re-use therein. Prior to effecting the recirculation the gaseous chlorine may be separated from the depleted alkali metal chloride solution, and the depleted solution may be mixed with alkali metal chloride or with fresh more concentrated aqueous alkali metal chloride solution prior to recirculation of the solution to the anode compartments. Recirculation of the aqueous alkali metal chloride solution enables the solution to be re-used, and it ensures that a high conversion of the alkali metal chloride may be effected without the conversion in a single pass through the anode compartments being so high that unacceptable concentration gradients result in the solution within the anode compartments of the cell, and between the solutions in different anode compartments of the cell, with consequent loss in current efficiency. Furthermore, as the solution removed from the cell is at high temperature the fresh solution may be at relatively low temperature. Indeed, it may be unnecessary to heat the fresh solution.

In such an electrolytic cell in which aqueous alkali metal chloride solution is electrolysed water is charged to the cathode compartments of the cell through an inlet header and hydrogen and aqueous alkali metal hydroxide solution are removed therefrom through an outlet header. The electrolytic cell may be equipped with means for recirculating the alkali metal hydroxide solution, or a part thereof, back to the cathode compartments of the cell in order to increase the concentration of alkali metal hydroxide in the solution. Prior to effecting the recirculation the gaseous hydrogen may be separated from the alkali metal hydroxide solution, and the solution may be mixed with water prior to recirculation. If such recirculation was not effected it would be difficult to produce a solution of alkali metal hydroxide of high concentration, and if such a solution of high concentration was produced without recirculation there would be substantial concentration gradients in the solution within the cathode compartments of the cell, and between the solutions in different cathode compartments of the cell, with a consequent unacceptable loss in current efficiency.

The recirculation may be effected by means of suitable pipework positioned externally of the electrolytic cell. For example, the outlet header from the anode compartments of the cell may be connected to a branched outlet pipe and part of the depleted electrolyte removed from the anode compartments of the electrolytic cell may be passed through the branched pipe to an inlet pipe, which is in turn connected to the inlet header of the anode compartments of the cell, and through which fresh electrolyte may also be charged to the anode compartments of the cell. Part of the electrolyte removed from the anode compartments of the electrolytic cell may be removed from the cell through the branched pipe. Similarly, the outlet header from the cathode compartments of the cell may be connected to a branched outlet pipe and part of the liquor removed from the cathode compartments of the electrolytic cell may be passed through the branched pipe to an inlet pipe, which is in turn connected to the inlet header of the cathode compartments of the electrolytic cell, and through which liquor, such as water, may also be charged to the cathode compartments of the cell. Part of the liquor removed from the cathode compartments of the electrolytic cell may be removed from the cell through the branched pipe.

An electrolytic cell having pipework positioned externally of the cell and through which liquors may be recirculated is described in U.S. Pat. No. 3,856,651. The recirculation system relies for its effectiveness on the gas-lift effect, and in the patent there is described a bipolar cell having a tank positioned on top of the cell to which chlorine-containing aqueous sodium chloride solution is passed from the anode compartments of the cell. Chlorine is separated from the solution in the tank, and the solution is removed from the tank and mixed with fresh, more concentrated sodium chloride solution and returned to the anode compartments of the cell via an externally positioned pipe.

The recirculation may also be effected within the anode compartments of an electrolytic cell, or within the cathode compartments of an electrolytic cell, by means of downcomers positioned in the compartments of the cell, for example, by means of a downcomer positioned between a pair of electrode plates in an electrode compartment of a cell and remote from the active electrode surfaces. Such recirculation also relies for its effectiveness on the gas-lift effect.

An electrolytic cell in which there is internal liquor recirculation is described in U.S. Pat. No. 4,557,816. In the patent there is described a duct which facilitates downward flow of electrolyte and which is positioned in a space to the rear of an electrode, the duct comprising a horizontal portion having a lower opening near the inlet for fresh electrolyte and a vertical portion in communication with the horizontal portion and having an upper opening near the outlet for the depleted electrolyte.

The present invention relates to an electrolytic cell, which is provided with an efficient means for recirculating liquors to the electrolytic cell, which is of simple construction, which does not rely on the gas-lift effect, and in which use is made of the energy present in fresh liquor charged to the electrolytic cell to cause recirculation of liquor, or a part thereof, which has been removed from the electrolytic cell.

According to the present invention there is provided an electrolytic cell which comprises at least one anode and at least one cathode, an inlet channel through which liquor may be charged to the electrolytic cell, and an outlet channel through which liquor may be removed from the electrolytic cell, in which the outlet channel is operatively connected to the inlet channel, and in which the inlet channel comprises an ejector.

The ejector is a simple device which is generally of tubular shape having an inlet end and a throat at or near an outlet end of the device, the throat at or near the outlet end being of smaller cross-sectional area than the inlet end. Thus, in operation liquor which is charged to the inlet end of the ejector is caused to issue from the outlet end of the ejector at an increased velocity, the issuing liquor entraining that liquor which is present in the outlet channel, which is operatively connected to the inlet channel comprising the ejector, thus causing the liquor which is present in the outlet channel to be recirculated to the electrolytic cell.

The inlet channel may be so shaped as to form an ejector, that is it may be of generally tubular shape and comprise a throat section positioned downstream of the inlet end of the inlet channel. Alternatively, the inlet channel may have an ejector positioned in the inlet channel.

The outlet channel of the electrolytic cell is operatively connected to the inlet channel of the cell so that liquor removed from the cell through the outlet channel may pass to the inlet channel leading back to the cell. For example, the outlet channel may be connected to a branch on the inlet channel. The operative connection, e.g. the branch on the inlet channel, is preferably located in the region of the ejector of the inlet channel so that the liquor issuing from the ejector may act on the liquor in the outlet channel and cause recirculation of the liquor from the outlet channel back to the electrolytic cell via the inlet channel. For example, the operative connection, e.g. the branch in the inlet channel, may be located at a position slightly upstream of the ejector, or at least of the throat of the ejector.

In operation of the electrolytic cell liquor is removed from the cell through the outlet channel and fresh liquor is charged to the cell through the inlet channel. Clearly, not all the liquor removed from the cell should be recirculated back to the cell and the inlet/outlet channels may be provided with means for removing from the channels a proportion of the liquors, and the gaseous products of electrolysis if any. These means may be provided by a branch channel on the outlet channel so that a proportion of the liquor which has been discharged from the cell, and the gaseous products, if any, may be removed from the outlet channel prior to the remainder of this liquor being mixed with the fresh liquor charged to the inlet channel. This is a preferred embodiment. Alternatively, the inlet channel, downstream of the ejector, may be provided with a branch channel so that a portion of the mixed liquors, that is liquor from the outlet channel which has been mixed with fresh liquor charged to the inlet channel, may be removed prior to the mixed liquors being charged to the electrolytic cell. This is a less preferred embodiment. The proportion of liquor which is removed may be controlled by means of an appropriate valve on the branch channel.

The inlet and outlet channels may be of suitable pipework the material of construction of which is resistant to corrosion by the liquors removed from and charged to the electrolytic cell.

Alternatively, in an embodiment which is particularly suitable for use with, and for attachment to, an electrolytic cell of the filter press type, the inlet and outlet channels may be formed in a unit made up of a plurality of shaped sheets which together form the required inlet and outlet channels. The sheets in the unit will in general be substantially planar, although they are not necessarily planar, and the sheets will in general be of the same or similar size, that is their external dimensions of length and breadth will be the same or similar. The sheets may each have the same or similar thickness, or they may be of different thicknesses. The sheets are so shaped that when positioned together they form the required inlet and outlet channels. The sheets may be shaped in a variety of different ways in order to provide the required channels. For example, one sheet may comprise a groove in a face of the sheet which when placed adjacent to a plane sheet, forms a channel in the plane of the sheets. Alternatively, two sheets may each comprise a groove in a face of each sheet which when placed adjacent to each other in the unit form a channel in the plane of the sheets. One sheet may comprise a slot which forms a channel in the plane of the sheets when plane sheets are positioned on either side of the slotted sheet.

The sheets may comprise an aperture or apertures therein which in the unit cooperate to form a channel or channels in a direction in the unit which is transverse to the plane of the sheets. The channel or channel in a direction transverse to the plane of the sheets may be operatively connected to the channel or channels in a direction which is in the plane of the sheets.

The sheets in the unit may be shaped, that is the sheets may be provided with apertures, slots, grooves or the like as required, by machining of substantially planar sheets, or, and particularly where the sheet is made of a suitable plastics material, by use of plastics processing techniques, for example compression moulding, injection moulding, or extrusion.

The sheets in the unit may be held together by means of tie rods, e.g. in the manner in which the components parts of a filter press cell may be held together by tie rods. Indeed, the same tie rods may be used to hold together the sheets of the unit and the component parts of the electrolytic cell, with the unit being positioned at one end of the electrolytic cell. Such units may be positioned at both ends of the electrolytic cell. Alternatively, the sheets of the unit, particularly when made of a plastics material, may be bonded together by use of a suitable adhesive or by use of heat welding or ultrasonic welding. Where the electrolytic cell comprises component parts, e.g. frame members, made of plastics material the unit may be similarly bonded to the electrolytic cell.

The outlet channel may be connected to an outlet header of the electrolytic cell, and the inlet channel may be connected to an inlet header of the electrolytic cell.

The electrolytic cell may comprise at least one anode and at least one cathode and a separator positioned between each anode and adjacent cathode thereby dividing the cell into separate anode and cathode compartments, or into a plurality of such compartments. The separator may be a microporous hydraulically permeable diaphragm or a hydraulically impermeable ion-exchange membrane.

The electrolytic cell may comprise an inlet channel through which liquor may be charged to the anode compartment(s) of the electrolytic cell, and an outlet channel through which liquor may be removed from the anode compartment(s) of the electrolytic cell, in which the outlet channel is operatively connected to the inlet channel, and in which the inlet channel comprises an ejector. Alternatively, or in addition, the electrolytic cell may comprise an inlet channel through which liquor may be charged to the cathode compartment(s) of the electrolytic cell, and an outlet channel through which liquor may be removed from the cathode compartment(s) of the electrolytic cell, in which the outlet channel is operatively connected to the inlet channel, and in which the inlet channel comprises an ejector.

Where the electrolytic cell comprises a unit of shaped sheets which together form the inlet and outlet channels the cell may be fitted with a single unit which provides the means for recirculating liquors to both the anode and cathode compartments of the cell, or the cell may be fitted with two units which separately provide the means for recirculating liquors to the anode compartments and to the cathode compartments of the cell.

Although the electrolytic cell of the invention may be used to electrolyse any suitable electrolyte it is particularly suitable for use in the electrolysis of an aqueous alkali metal chloride solution, for example aqueous sodium chloride solution, and the invention will in general be described hereafter by reference to the electrolysis of aqueous sodium chloride solution.

The electrolytic cell may be a monopolar cell or a bipolar cell. In a monopolar cell a separator is positioned between each anode and adjacent cathode. The electrolytic cell may be a bipolar cell comprising a plurality of electrodes having an anode face and a cathode face. In a bipolar cell a separator is positioned between an anode face of an electrode and a cathode face of an adjacent electrode.

A preferred form of electrolytic cell is a cell of the filter press type which comprises a plurality of substantially planar anodes and cathodes and a plurality of gaskets of an electrically non-conducting material. In the electrolytic cell the gaskets may be positioned between adjacent anodes and cathodes thereby providing the required electrical insulation between the anodes and cathodes, or the anodes and cathodes may be positioned within frame-like gaskets. The inlet headers and outlet headers of the electrolytic cell may take any form but they may be formed by apertures in the gaskets, and in the anodes and cathodes when the gaskets are positioned between the anodes and cathodes, these apertures in the electrolytic cell together forming the headers. The gaskets, or the anodes and cathodes, may have means, for example slots, through which liquors may be charged to the anode and cathode compartments from the headers and through which liquors may be removed from the anode and cathode compartments to the headers.

In the electrolytic cell the separator may be positioned between adjacent anode and cathode frame-like gaskets. It may be sealed to one or other or to both of the frame-like gaskets, or it may merely be held in position by being trapped between the frame-like gaskets. Thus, the separator may have a surface area greater than that of the anode or cathode but not so great as to cover the entire face of a frame-like gasket. The separator may be positioned in a recess in the frame-like gasket and sealed thereto. In this embodiment of the electrolytic cell the frame-like gaskets of electrically non-conducting plastics material within which the anodes and cathodes are Positioned may be sealed directly to each other with a separator trapped therebetween.

In an alternative embodiment, the separator may be sealed to and, for example, positioned within a frame-like gasket of an electrically non-conducting plastics material other than those to which the anodes and cathodes are fixed. This separator frame-like gasket may be positioned between frame-like gaskets to which anodes and frame-like gaskets to which cathodes are affixed and be bonded thereto. In this case the anode and cathode frame-like gaskets may be bonded indirectly to each other via the separator frame-like gasket.

The electrolytic cell may comprise frame-like gaskets of an electrically non-conducting plastics material other than those to which the anodes and cathodes are affixed or to which the separators are affixed. For example, the electrolytic cell may comprise such frame-like gaskets having a central opening therein to provide in the electrolytic cell a space for the anode and cathode compartments. Such a frame-like gasket may be positioned in the electrolytic cell between the separator, or frame-like gasket associated with the separator, and an adjacent anode gasket, and between the separator, or anode frame-like gasket associated with the separator, and an adjacent cathode frame-like gasket. Alternatively, space for the anode and cathode compartments may be provided by using anode and cathode frame-like gaskets, and/or separator frame-like gaskets of a thickness such as to provide the required space. For example, the anode and cathode frame-like gaskets may have a central opening therein in which the anode and cathode respectively are positioned and the frame-like gaskets may have a thickness greater than that of the anode and cathode.

The frame-like gaskets of the electrolytic cell are made of an electrically non-conducting plastics material, which may be thermoplastic or thermoset, and which may be of an elastomeric material.

The plastics material may be a polyolefin, for example, polyethylene, polypropylene, or an elastomeric polyolefin, e.g. an ethylene-propylene copolymer elastomer or an ethylene-propylene-diene copolymer elastomer. Polyolefins have the advantage that they are readily bonded to each other by a number of different techniques, for example, heat welding, ultrasonic welding, or by the use of adhesives in order to form the unit, as will be described in greater detail hereafter. However, polyolefins may not be sufficiently resistant to corrosion by the liquors in the electrolytic cell and it may be desirable, in order to increase the corrosion resistance, to provide a coating of a corrosion resistant material, for example a fluoropolymer, e.g. polytetrafluoroethylene, at least on those surfaces of the polyolefin sheets which in the unit contact these liquors.

The plastics material may be a halogenated polyolefin, for example, polyvinyl chloride. Preferred halogenated polyolefins are fluorine-containing polyolefins, for example polyvinylidene fluoride, polyhexafluoropropylene, fluorinated ethylene-propylene copolymer, and particularly polytetrafluoroethylene, on account of the corrosion resistance of such fluorine-containing polyolefins. Such fluorine-containing polyolefins are not readily bonded by means of adhesives. They may be bonded by the use of heat welding or ultrasonic welding.

A preferred plastics material is an acrylonitrile-butadiene-styrene polymer. Such a plastics material is well-known in the art and is readily available commercially. We have found that it is surprisingly resistant to corrosion by liquors such as sodium chloride and sodium hydroxide solution and that it possesses the additional advantages that it is readily fabricated by a number of different plastics processing techniques, for example, injection moulding, compression moulding and extrusion, and that gaskets of such a plastics material are readily bonded to each other by a number of different techniques.

In the embodiment of the invention in which the inlet and outlet channels are formed in a unit made up of a plurality of shaped sheets which together form the required inlet and outlet channels the sheets are suitably formed of a electrically non-conducting plastics material as herein described.

The anodes and cathodes of the electrolytic cell must be electro-conducting and they should have an electrocatalytically active surface. The anodes and/or cathodes may consist of a metallic substrate, which may have a foraminate structure, for example it may be a perforated plate or it may be in the form of a mesh, e.g. a woven or non-woven mesh or an expanded metal. Alternatively, the anodes and/or cathodes may comprise a plurality of elongated members which are preferably parallel to each other and which are also preferably vertically disposed in the electrolytic cell.

A suitable metal for the anode is selected from the film-forming metals, for example, titanium, tantalum, zirconium, or hafnium.

A suitable metal for the cathode is steel or nickel.

The anode and/or cathode may comprise a core of another metal having an outer face of one of the above metals.

Suitable electrocatalytically active coatings which may be applied to the surface of the anodes and/or cathodes include, in the case of anodes, an oxide of a platinum group metal preferably in admixture with an oxide of a film-forming metal, particularly in the form of a solid solution, and, in the case of cathodes, a platinum group metal. Such coatings, and methods of application, are well-known in the art.

The anode and/or the cathode may itself comprise a substrate of a plastics material which material may be the same as or different from the plastics material of the frame member. As the substrate must be electroconducting, and as plastics materials are generally electrically non-conducting, it follows that the plastic substrate must be modified so as to make it electro-conducting. Such modification may be achieved in a number of different ways. For example, the substrate of plastics material may be filled with a substantial proportion of carbon black or graphite or particulate metal. It may comprise metallic fibre or non-metallic fibre having a coating of metal. The fibre may be randomly distributed throughout the substrate of plastics material. Alternatively, or in addition, the substrate of plastics material may have one or more foraminate metal members embedded therein, e.g. in the form of a mesh, which may be woven or unwoven or which may be in the form of an expanded metal. The embedded metal member may act as a current distributor in the case where the anode or cathode is monopolar, in which case it may project from an edge of the plastics substrate and through the frame member in order to provide a means for electrical connection.

The substrate of plastics material may carry a metal layer on its face, for example a layer of a film-forming metal in the case of an anode, and a layer of nickel in the case of a cathode.

The substrate of plastics material may function as a bipolar electrode, in which case it conveniently may carry a layer of a film-forming metal on its anode face and a layer of nickel on its cathode face.

Where the anode and/or cathode is a metal coated substrate of a plastics material it is particularly suitable to use as the substrate an acrylonitrile-butadiene-styrene polymer material as such a material is readily metal coated.

Where the separator is a hydraulically permeable diaphragm it may be made of a porous organic polymeric material. Preferred organic polymeric materials are fluorine-containing polymers on account of the generally stable nature of such materials in the corrosive environment encountered in chlor-alkali electrolytic cells. Suitable fluorine-containing polymeric materials include, for example, polychlorotrifluoroethylene, fluorinated ethylene-propylene copolymer, and polyhexafluoropropylene. A preferred fluorine-containing polymeric material is polytetrafluoroethylene on account of its great stability in corrosive chlor-alkali electrolytic cell environments.

Such hydraulically permeable diaphragm materials are known in the art.

Preferred separators for use as membranes which are capable of transferring ionic species between the anode and cathode compartments of an electrolytic cell are those which are cation perm-selective. Such ion exchange materials are known in the art and are preferably fluorine-containing polymeric materials containing anionic groups. The polymeric materials preferably are fluorocarbons containing the repeating groups $$[C_mF_{2m}]_M \text{ and } [CF_2-\underset{\underset{X}{|}}{CF}]_N$$

where m has a value of 2 to 10, and is preferably 2, the ratio of M to N is preferably such as to give an equivalent weight of the groups X in the range 600 to 2000, and X is chosen from $$A \text{ or } [OCF_2-\underset{\underset{Z}{|}}{CF}]_pA$$

where p has a value of for example 1 to 3, Z is fluorine or a perfluoroalkyl group having from 1 to 10 carbon atoms, and A is a group chosen from the groups:

$-SO_3H$ $-CF_2SO_3H$ $-CCl_2SO_3H$ $-X^1SO_3H$ $-PO_3H_2$ $-PO_2H_2$ $-COOH$ and $-X^1OH$ or derivatives of the said groups, where $X^1$ is an aryl group. Preferably A represents the group $-SO_3H$ or $-COOH$. $SO_3H$ group-containing ion exchange membranes are sold under the tradename 'Nafion' by E. I. du Pont de Nemours and Co. Inc. and —COOH group-containing ion exchange membranes under the tradename 'Flemion' by the Asahi Glass Co. Ltd.

BRIEF DESCRIPTION OF THE DRAWING

Specific embodiments of the electrolytic cell of the invention will now be described with the aid of the accompanying drawings in which.

DETAILED DESCRIPTION OF THE DRAWING

Figure 1:
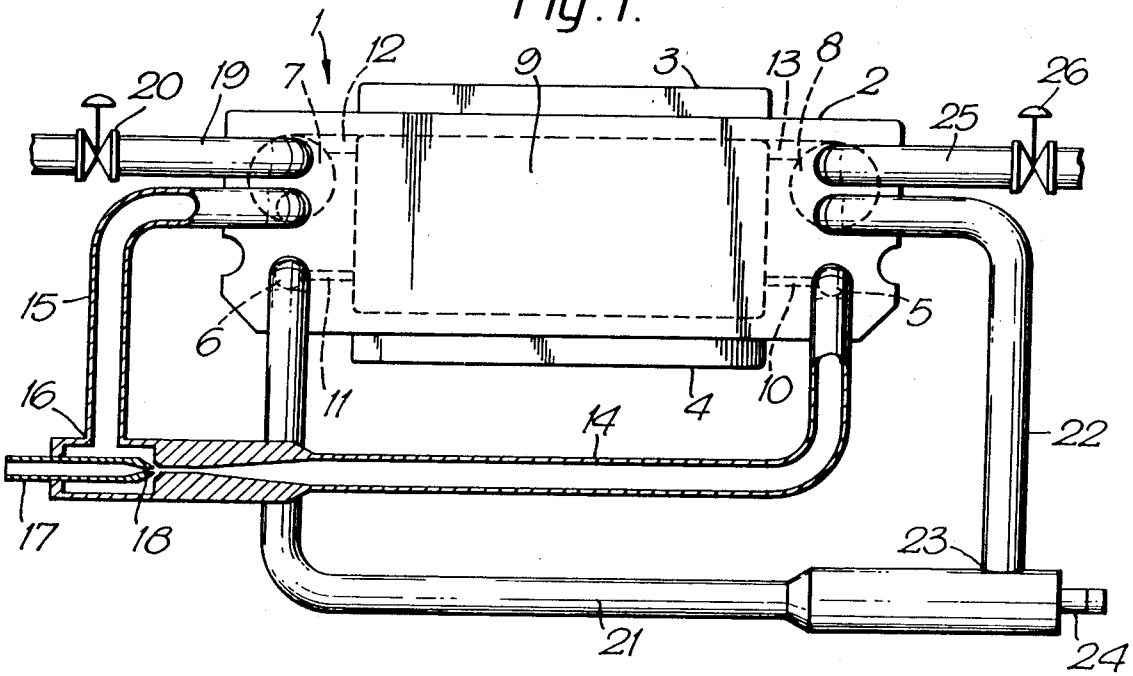
FIG. 1 shows an electrolytic cell of the invention and associated liquor recirculation means, the latter being partly in cross-section.

Referring to FIG. 1 the electrolytic cell is of the filter press type which comprises a plurality of plate-like anodes, cathodes, and gaskets positioned between each anode and adjacent cathode, a cationexchange membrane also being positioned between each anode and adjacent cathode. It is unnecessary to show in detail the construction of the electrolytic cell. Electrolytic cells of this basic type are described, for example, in our British Patent No. 1595183 and in our European Patent No. 45148.

The embodiment of FIG. 1 shows an end view of the electrolytic cell 1, the cell comprising an end plate 2. Also shown in FIG. 1 are the extensions 3 and 4 of the anodes and cathodes respectively to which appropriate electrical connections are made.

Each of the anodes, cathodes, and gaskets (not shown), but not the end plate 2, comprises four apertures 5, 6, 7, 8 which in the cell together form headers lengthwise of the cell through which, respectively, there are charged to the cell aqueous sodium chloride solution and water or dilute aqueous sodium hydroxide solution, and through which there are removed from the cell chlorine and depleted aqueous sodium chloride solution, and hydrogen and aqueous sodium hydroxide solution. The solutions are charged to, or removed from, the anode and cathode compartments 9, as the case may be, via channels 10, 11, 12, 13 respectively in the walls of the gaskets.

The recirculation means comprises an inlet pipe 14 which is attached to end plate 2 and thus to the header formed of apertures 5, and an outlet pipe 15 which is attached to end plate 2 and thus to the header formed of apertures 7, the operative connection between inlet pipe 14 and outlet pipe 15 being provided at branch 16. Inlet pipe 14 comprises a tubular ejector 17 having a throat 18 positioned in the inlet pipe in a position at which the throat 18 is slightly downstream of the branch 16. The end plate 2 also has a pipe 19 attached thereto, and pipe 19 comprises a valve 20. Chlorine and a part of the aqueous sodium chloride solution may be removed from the anode compartments of the cell through pipe 19 and valve 20.

The recirculation means also comprises an inlet pipe 21 which is attached to end plate 2 and thus to the header formed of apertures 6, and an outlet pipe 22 which is attached to the end plate 22 and thus to the header formed of apertures 8, the operative connection between inlet pipe 21 and outlet pipe 22 being provided at branch 23. Inlet pipe 21 comprises a tubular ejector 24 having a throat (not shown) positioned in the inlet pipe 21 in a position at which the throat is slightly downstream of the branch 23.

The end plate 2 also has a pipe 25 attached thereto, and pipe 25 comprises a valve 26. Hydrogen and a part of the aqueous sodium hydroxide solution may be removed from the cathode compartments of the cell through pipe 25 and valve 26.

In operation concentrated aqueous sodium chloride solution, which may be a saturated solution, is charged to inlet pipe 14 via ejector 17 and thence into the anode compartments 9 of the electrolytic cell 1 via the header of which apertures 5 form a part and channel 10. Chlorine and depleted aqueous sodium chloride solution are discharged from the anode compartments 9 of electrolytic cell 1 via channels 12 and the headers of which apertures 7 form a part. Chlorine and a part of the solution are discharged via pipe 19 and the remainder of the solution passes to pipe 15. The depleted solution passes to branch 16 and into inlet pipe 14 and is entrained in the concentrated solution issuing from the ejector 17 and is caused to pass along inlet pipe 14 and thence to the anode compartments 9.

Water or dilute aqueous sodium hydroxide solution is charged to inlet pipe 21 via ejector 24 and thence into the cathode compartments 9 of the electrolytic cell 1 via the header of which apertures 6 form a part and channel 11. Hydrogen and aqueous sodium hydroxide solution are discharged from the cathode compartments 9 of electrolytic cell 1 via channels 13 and the headers of which apertures 8 form a part. Hydrogen and a part of the solution are discharged via pipe 25 and the remainder of the solution passes to pipe 22. The solution passes to branch 23 and into inlet pipe 21 and is entrained in the water or the solution issuing from the ejector 24 and is caused to pass along the inlet pipe 21 and thence to the cathode compartments 9.

Figure 2:
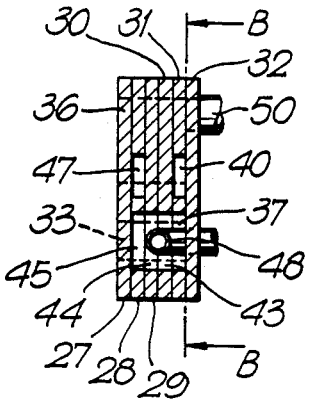
FIG. 2 shows a unit in which liquor recirculation may be effected which is made up of a plurality of shaped sheets, the view of FIG. 2 being in cross-section along the line indicated at A—A of FIG. 3.
Figure 3:
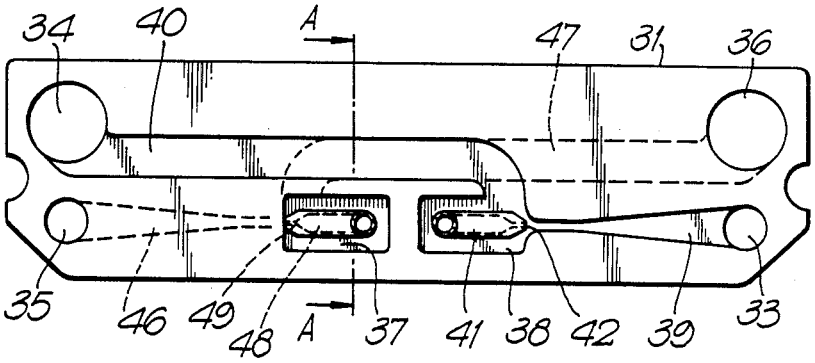
FIG. 3 shows an end view in elevation of one of the sheets from which the unit is made up, the view being along the line B—B of FIG. 2.

Referring to FIGS. 2 and 3 the liquor recirculation unit shown therein comprises six plates 27, 28, 29, 30, 31, 32 made of acrylonitrile-butadienestyrene copolymer. Each of the plates 27, 28, 29, 30 and 31 comprises four apertures 33, 34, 35, 36 in a direction transverse to the plane of the plates which together form, respectively, a part of an inlet channel through which aqueous sodium chloride solution is charged to the anode compartments 9 of the electrolytic cell 1, a part of an outlet channel to which chlorine and depleted aqueous sodium chloride solution are discharged from the anode compartments 9 of the electrolytic cell 1, a part of an inlet channel through which water or dilute aqueous sodium hydroxide solution is charged to the cathode compartments 9 of the electrolytic cell 1, and a part of an outlet channel to which hydrogen and concentrated aqueous sodium hydroxide solution are discharged from the cathode compartments 9 of the electrolytic cell 1.

Plate 31 comprises a cavity 37 and a cavity 38 and a channel 39 which leads to aperture 33 and which forms a part of the inlet channel through which aqueous sodium chloride solution is charged to the anode compartments 9 of the electrolytic cell 1. Plate 31 also comprises a channel 40 which forms a part of the outlet channel through which depleted aqueous sodium chloride solution is discharged from the anode compartments 9 of the electrolytic cell 1. Channel 40 leads to cavity 38. An ejector 41 having a throat 42 is positioned in cavity 38.

Plates 30 and 29 comprise cavities 43 and 44 respectively which correspond in position to cavity 37 in plate 31 and two further cavities which are not shown and which correspond in position to cavity 38 in plate 31.

Plate 28 comprises a cavity 45 which corresponds in position to cavity 37 in plate 31 and a cavity not shown which corresponds in position to cavity 38 in plate 31, and a channel 46 which leads to apertures 35 and which forms a part of the inlet channel through which water or dilute aqueous sodium hydroxide solution is charged to the cathode compartments 9 of the electrolytic cell 1. Plate 28 also comprises a channel 47 which forms a part of the outlet channel through which concentrated aqueous sodium hydroxide solution is discharged from the cathode compartments 9 of the electrolytic cell 1. Channel 47 leads to cavity 37. An ejector 48 having a throat 49 is positioned in cavity 37.

The channels formed of apertures 33, 35, 34, 36 are connected, respectively, to the headers of the electrolytic cell 1, as shown in FIG. 1, formed of apertures 5, 7, 6 and 8.

Plate 32 comprises a channel 50 leading to aperture 36 and through which a part of the aqueous sodium hydroxide solution and the hydrogen discharged from the cell may be removed, and a channel (not shown) leading to aperture 34 and through which a part of the aqueous sodium chloride solution and the chlorine discharged from the cell may be removed.

The plates 27, 28, 29, 30, 31, 32 may be held together, and to the electrolytic cell as shown in FIG. 1, by means of tie rods, or they may be bonded together, and to the end plate 2 of the cell, by means of an adhesive.

In operation concentrated aqueous sodium chloride solution is charged to the anode compartments 9 of the electrolytic cell 1 through ejector 41 and along channel 39 and the header formed of apertures 33. Depleted aqueous sodium chloride solution is discharged from the anode compartments 9 of the electrolytic cell through the header formed of apertures 34 and through channel 40 to cavity 38. Chlorine, and a part of the depleted solution, are removed through the channel (not shown) in plate 32 which leads to aperture 34. The depleted solution from channel 40 is entrained in solution issuing from the throat 42 of ejector 41 thus causing the depleted solution from channel 40 to be passed along channel 39 with the concentrated solution and to be recirculated to the anode compartments 9 of the electrolytic cell 1.

Water or dilute aqueous sodium hydroxide solution is charged to the cathode compartments 9 of the electrolytic cell 1 through ejector 48 and along channel 46 and the header formed of apertures 35. Aqueous sodium hydroxide solution is discharged from the cathode compartments 9 of the electrolytic cell through the header formed of apertures 36 and through channel 47 to cavity 37. Hydrogen, and a part of the solution discharged from the cell, are removed through the channel 50 in plate 32 which leads to aperture 36.

The solution from channel 47 is entrained in the water or dilute aqueous sodium hydroxide solution issuing from the throat 49 of ejector 48 thus causing the solution from channel 47 to be passed along channel 46 with the water or dilute solution and to be recirculated to the cathode compartments 9 of the electrolytic cell 1.

I claim:

1. An electrolytic cell which comprises at least one anode and at least one cathode, an inlet channel through which liquor may be charged to the electrolytic cell, and an outlet channel through which liquor may be removed from the electrolytic cell, in which the outlet channel is operatively connected to the inlet channel, in which the inlet and outlet channels are formed in a unit made up of a plurality of shaped sheets which together form the inlet and outlet channels, and in which the inlet channel comprises an ejector.

2. An electrolytic cell as claimed in claim 1 in which the operative connection between the inlet channel and the outlet channel is located at a position upstream of the ejector.

3. An electrolytic cell as claimed in claim 1 in which the sheets are substantially planar.

4. An electrolytic cell as claimed in claim 1 in which a sheet of the unit comprises a groove in a face of the sheet which, when placed adjacent to a plane sheet, forms a channel in the plane of the sheet.

5. An electrolytic cell as claimed in claim 1 in which two sheets of the unit each comprise a groove in a face of each sheet which when placed adjacent to each other in the unit form a channel in the plane of the sheets.

6. An electrolytic cell as claimed in claim 1 in which a sheet of the unit comprises a slot which forms a channel in the plane of the sheet when plane sheets are positioned on either side of the slotted sheet.

7. An electrolytic cell as claimed in any one of claims 1 to 6 in which the electrolytic cell comprises an inlet header, and in which the inlet channel is connected to the inlet header.

8. An electrolytic cell as claimed in any one of claims 2 to 6 in which the electrolytic cell comprises at least one anode and at least one cathode and a separator positioned between each anode and adjacent cathode thereby dividing the cell into separate anode and cathode compartments.

9. An electrolytic cell as claimed in claim 8 which comprises an inlet channel through which liquor may be charged to the anode compartment(s) of the electrolytic cell, and an outlet channel through which liquor may be removed from the anode compartment(s) of the electrolytic cell, in which the outlet channel is operatively connected to the inlet channel, and in which the inlet channel comprises an ejector.

10. An electrolytic cell as claimed in claim 9 which comprises an inlet channel through which liquor may be charged to the cathode compartment(s) of the electrolytic cell, and an outlet channel through which liquor may be removed from the cathode compartment(s) of the electrolytic cell, in which the outlet channel is operatively connected to the inlet channel, and in which the inlet channel comprises an ejector.

11. An electrolytic cell as claimed in any one of claims 1 to 6 in which the unit is formed of a plurality of shaped sheets of an electrically nonconducting plastics material.

12. A process for the electrolysis of an aqueous solution of an alkali metal chloride in which the electrolysis is effected in an electrolytic cell as claimed in any one of claims 2 to 6.

* * * * *